US006223353B1

(12) United States Patent
Lardieri, Jr.

(10) Patent No.: US 6,223,353 B1
(45) Date of Patent: May 1, 2001

(54) DEVICE AND METHOD FOR IMPROVING A PERSON'S CONTROL OF THEIR NON-DOMINANT HAND

(76) Inventor: Ralph Lardieri, Jr., 41 Chelsea Ct., Franklin Park, NJ (US) 08823

( * ) Notice: Subject to any disclaimer, the term of this patent is extended or adjusted under 35 U.S.C. 154(b) by 0 days.

(21) Appl. No.: 09/476,888

(22) Filed: Jan. 3, 2000

(51) Int. Cl.[7] ..... A41D 19/00
(52) U.S. Cl. ..... 2/161.1; 2/160; 473/450
(58) Field of Search ..... 2/16, 20, 159, 2/160, 161.1, 161.2, 161.3, 161.6, 167; 473/59, 615, FOR 101, 450

(56) References Cited

U.S. PATENT DOCUMENTS

| | | | | |
|---|---|---|---|---|
| D. 313,496 | | 1/1991 | Pesta | D2/250 |
| 3,581,312 | | 6/1971 | Nickels | 2/159 |
| 3,707,730 | | 1/1973 | Slider | 2/161 A |
| 4,624,016 | * | 11/1986 | Luevano | 2/161 |
| 4,679,799 | * | 7/1987 | Coletti | 273/318 |
| 4,738,447 | | 4/1988 | Brown | 273/1.5 |
| 4,881,275 | | 11/1989 | Cazares et al. | 2/161 A |
| 4,909,117 | | 3/1990 | Reiling | 84/738 |
| 5,339,465 | * | 8/1994 | Kyewski | 2/20 |
| 5,479,660 | * | 1/1996 | Najac | 2/20 |
| 5,603,679 | * | 2/1997 | Reis | 482/106 |
| 5,636,381 | | 6/1997 | Brogden | 2/161.1 |
| 5,819,313 | * | 10/1998 | McCrane | 2/16 |
| 5,833,233 | * | 11/1998 | Strug | 273/1.5 |
| 5,896,584 | * | 4/1999 | Hauser | 2/161.1 |

* cited by examiner

*Primary Examiner*—John J. Calvert
*Assistant Examiner*—Katherine Moran
(74) *Attorney, Agent, or Firm*—LaMorte & Associates

(57) ABSTRACT

A glove assembly that is designed to diminish the usefulness of a person's dominant hand to a point below that of the non-dominant hand, but not so low as to render the dominant hand unusable. The glove assembly includes a glove with a palmward surface. A convex protrusion extends from the palmward surface of the glove and covers at least a majority of the palmward surface. The convex protrusion prevents the palm of the overall glove assembly from being configured into a concave configuration, regardless of the orientation of the hand within the glove. Since the palm of the glove assembly cannot become concave, the glove assembly decreases the ability of a person to grasp and manipulate the curved surface of a ball.

12 Claims, 4 Drawing Sheets

DEVICE AND METHOD FOR IMPROVING A PERSON'S CONTROL OF THEIR NON-DOMINANT HAND

BACKGROUND OF THE INVENTION

1. Field of the Invention

In general, the present invention relates to devices that attach to a person's dominant hand in order to cause that person to favor their non-dominant hand when performing a specific task. More particularly, the present invention is related to devices that attach to a person's dominant hand that reduce a person's control of that hand when playing the game of basketball.

2. Description of the Prior Art

By natural design, most people have a dominant hand, that is, they are either right handed or left handed. When performing most tasks, a person favors his/her dominant hand. As a result, the dominant hand and arm are used more often than are the opposite hand and arm. The dominant hand and arm, therefore, tend to be stronger than the non-dominant hand and arm. Furthermore, a person's hand-to-eye coordination tends to be greater with the dominant hand and arm, than with their non-dominant hand and arm.

There are many sports that require a person to use both of their hands at different times. In such sports, a person who is ambidextrous has a distinct advantage over his/her competitors. For example, in the game of basketball, a person who can dribble, shoot and pass with either hand has an advantage over a competitor who can only dribble, shoot and pass with their dominant hand.

One of the most effective ways to promote ambidexterity is to impede the performance of a person's dominant hand. In this manner, a person has no option but to use their non-dominant hand. Trainers for many different sports often cause athletes to train with their dominant hand restrained. This causes the athlete to use only their non-dominant hands. The continued use of the non-dominant hand increases the strength of the non-dominant hand and increases an athlete's hand-to-eye coordination with that hand. With repeated training, the performance of an athlete's non-dominant hand and arm can be brought into par with that of the athlete's dominant hand and arm.

A problem associated with the training technique of restraining the dominant hand is that technique can only be used in non-competitive situations. Obviously, a basketball player cannot play effectively against an opponent with one arm restrained. As a result, the restraining of the dominant hand is only an option during practice. However, many sports, such as basketball, are team sports where the players interact with one another during practice. In such team sports, it would be both dangerous to the player and counter productive to the team for one player to restrain one of his/her arms during practice.

A need therefore exists for a device and method that causes a person to favor their non-dominant hand when playing a sport without restraining the dominant hand or arm. This need is met by the present invention as is described and claimed below.

The present invention is a glove that fits onto the dominant hand and lowers the dexterity of that hand to a level below that of the non-dominant hand.

In the prior art record, there are many different types of devices that attach to a person's hand for the general purpose of sports training. However, these prior art devices are typically designed to improve a person's hand-to-eye coordination, or otherwise train the hand to maintain some theoretically correct position. Such prior art devices are exemplified by U.S. Pat. No. 4,738,447 to Brown, entitled, Basketball Player's Training Glove; U.S. Pat. No. 3,707,730 to Slider, entitled, Basketball Practice Glove; and U.S. Pat. No. 3,581,312 to Nickels, entitled Basketball Training Glove. The Applicant is unaware of any prior art glove that is designed to intentionally decrease a person's hand-to-eye coordination by preventing a hand from conforming to certain configurations. Accordingly, the present invention is believed to be useful, novel and an advancement in the art.

SUMMARY OF THE INVENTION

The present invention is a glove assembly that is designed to diminish the usefulness of a person's dominant hand to a point below that of the non-dominant hand, but not so low as to render the dominant hand unusable. The glove assembly includes a glove with a palmward surface that covers the palm of a hand and most of the palmward surface of the fingers. A convex protrusion extends from the palmward surface of the glove. The convex protrusion covers at least a majority of the palmward surface, wherein the convex protrusion covers a majority of the palm and the fingers. The convex protrusion prevents the palmward surface of the overall glove assembly from being configured into a concave configuration, regardless of the orientation of the hand within the glove. Since the palmward surface of the glove assembly cannot become concave, the glove assembly decreases the ability of a person to grasp and manipulate the curved surface of a ball. As a result, when a person wears the glove and plays a sport that requires the manipulation of a ball, the usefulness of the hand with the glove is diminished.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Although the present invention can be used to improve a person's coordination in their non-dominant hand for playing many different sports, such as football, volleyball, water polo and the like, the present invention is particularly advantageous for use in training for basketball. Consequently, by way of example, the present invention device and method will be described in conjunction with training for the sport of basketball. Such a description is merely exemplary of the best mode contemplated for the device and should not be regarded as a limitation as to the claimed uses of the device.

Figure 1:
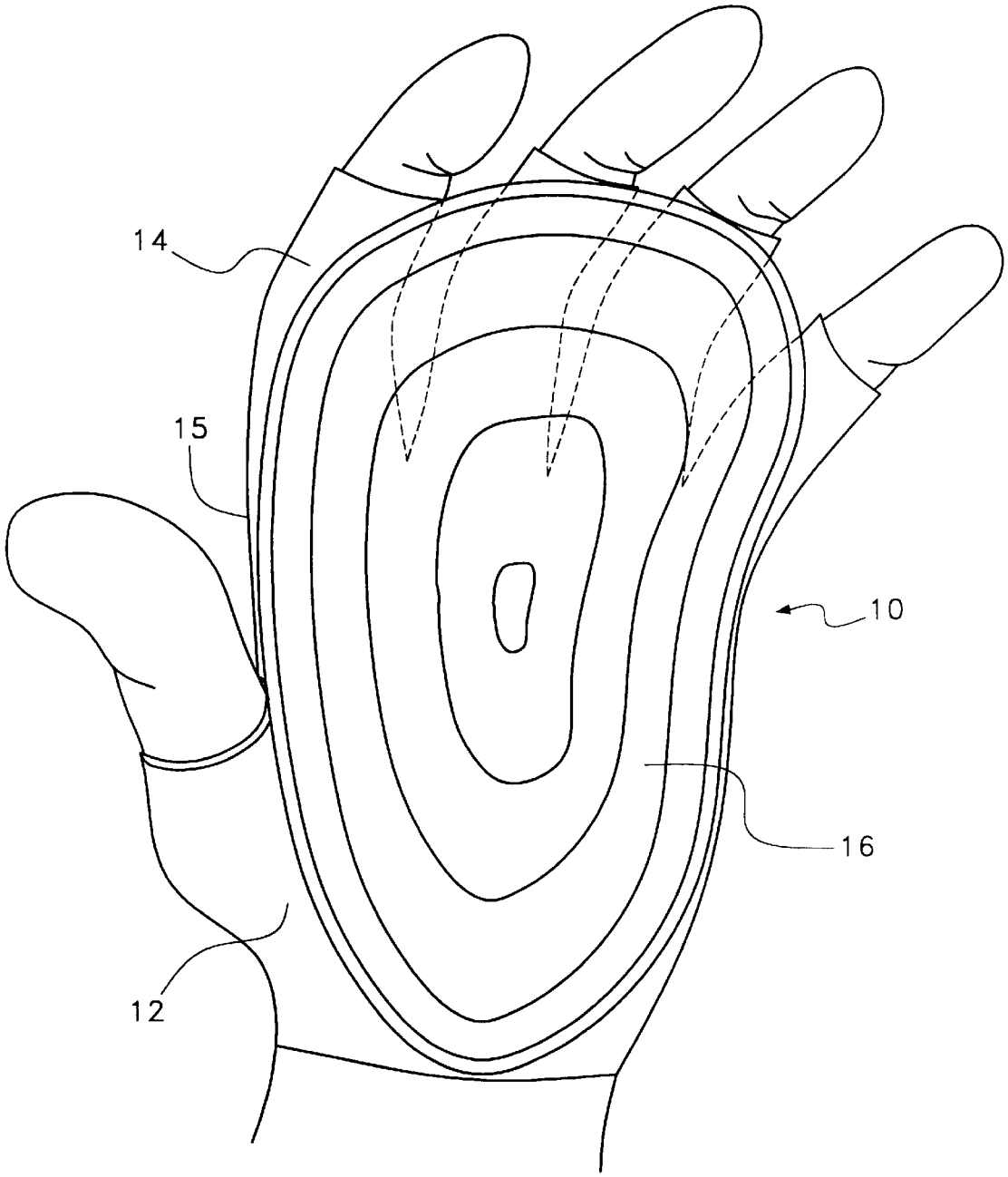
FIG. 1 is a perspective view of an exemplary embodiment of the present invention device shown in use on a person's hand.

Referring to FIG. 1, an embodiment of the present invention glove device 10 is shown. The glove device 10 can be either a right handed glove or a left handed glove. In the shown embodiment, a left handed glove is shown. The glove device 10 should be worn on the dominant hand of the wearer.

The glove device 10 defines a central pocket through which a person's hand passes. That central pocket has a palm section 12 that covers the palm of the hand. The glove device 10 also has appendages 14 through which the fingers of the hand pass. The appendages 14 can cover the entire finger, if desired. However, in the shown embodiment, the finger appendages 14 are truncated so that each appendage 14 terminates in the area above the proximal phalange of each finger. The palm section 12 of the glove device 10 and the palmward side of the finger appendages 14 are collectively referred to at the palmward side 15 of the glove device 10.

The glove device 10 can be made of most any material. However, since the glove device 10 is intended to be worn when playing a sport, it is desired that the glove device 10 be made of a material that has elastic properties. As such, the glove device 10 closely conforms to the contours of the hand and will not inadvertently fall away from the hand when a sport is being played.

Figure 2:
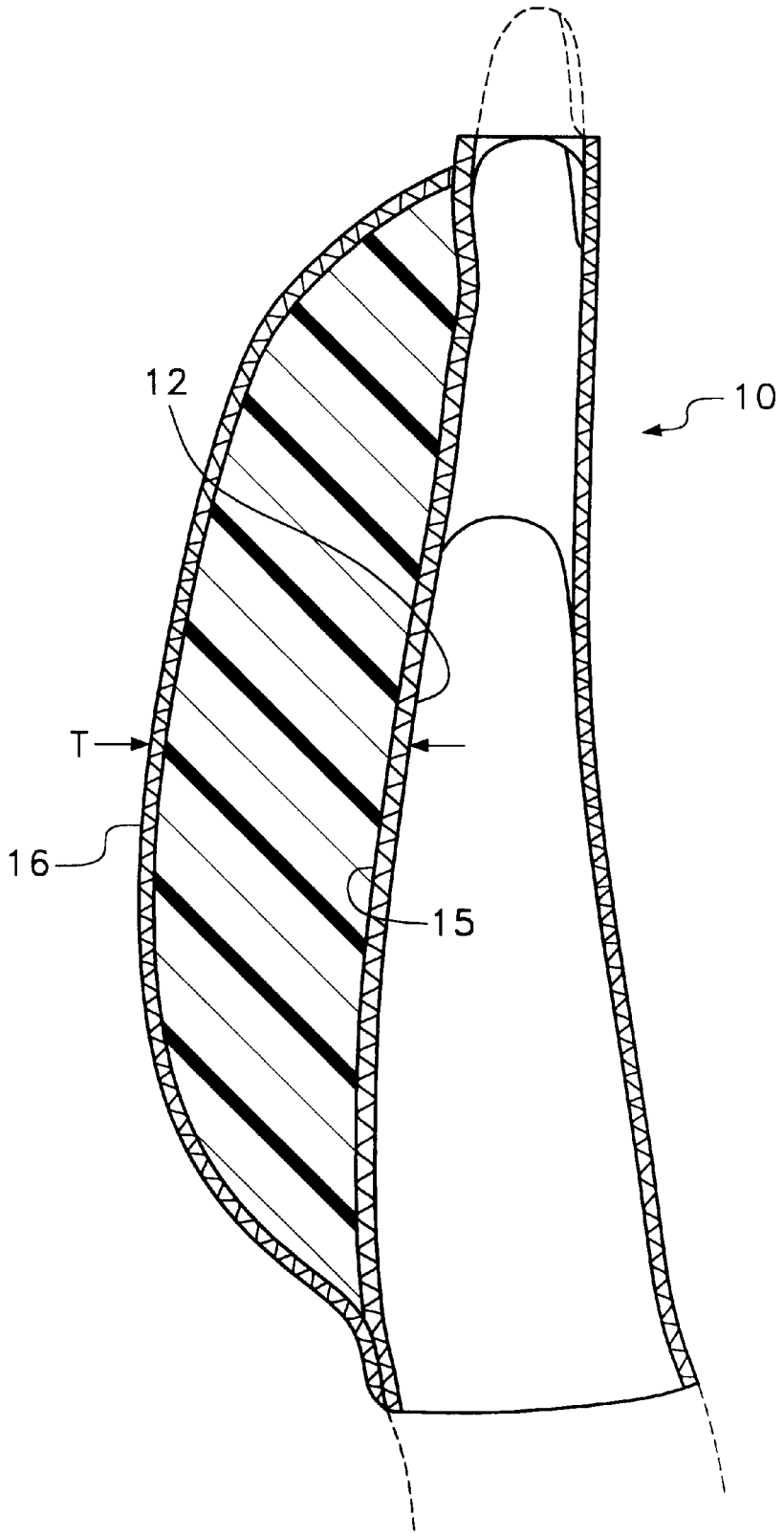
FIG. 2 is a cross-sectional view of the embodiment of FIG. 1, viewed along section line 2—2.

Referring to FIG. 1, in conjunction with FIG. 2, it can be seen that a convex structure 16 is present on the palmward side 15 of the glove device 10. When the glove device 10 is worn, the convex structure 16 extends from the base of the palm towards the tips of the fingers at the top of the glove device 10, thereby extending the whole length of the palmward side 15 of the glove device 10. Referring solely to FIG. 2, it can be seen that the convex structure 16 reaches its maximum thickness T at a point proximate the center of the palmward side 15 of the glove device 10. The maximum thickness T preferably being between one half inch and three inches, however, larger values could also be used.

The convex structure 16 has an outer material skin that is preferably made of the same material as is the remainder of the glove device 10. However, the body of the convex structure 16 is fabricated from an elastomeric material, such as foam rubber or silicon rubber. When the glove device 10 is worn, the convex structure 16 extends outwardly from the palmward surface 15 of the glove device 10 and therefore the palmward side of the hand. The hand within the glove device 10 is unrestricted in its ability to move. When the glove device 10 is worn each finger can move, as can the palm. However, the area in front of the palm is occupied by the convex structure 16. The convex structure 16 is flexible so it does not restrict any movement of the hand. However, the presence of the convex structure 16 in the palm of the hand prevents the palmward surface 15 of the overall glove device 10 from being configured into a concave orientation, regardless of the manipulations of the hand. As a result, the convex structure 16 makes it difficult for the hand to engage and manipulate curved surfaces, such as the surface of a basketball.

When a person dribbles or shoots a basketball, a person conforms his/her hand to match the curvature of the basketball. By configuring the hand in such a manner, a person has better contact with the basketball and better control of the basketball. Utilizing the glove device 10, a person cannot conform their dominant hand to match the curvature of the basketball. The convex structure 16 on the glove device 10 always remains in a convex configuration regardless of how the hand is manipulated.

Accordingly, when a person is wearing the glove device 10 on their dominant hand, the ability of that person to accurately dribble the basketball, pass the basketball or shoot the basketball with their dominant hand is greatly reduced. The decrease in hand dexterity created by the glove device 10 causes the performance of a person's dominant hand to fall below that of their non-dominant hand. As a result, a person's naturally non-dominant hand will become that person's temporary dominant hand. A person will then begin to rely upon their naturally non-dominant hand more and more, thereby increasing that person's coordination with their non-dominant hand.

The size of the glove device 10 can be altered to match the needs of a particular person. The larger the glove device 10 and the convex structure 16 that extends from the glove device 10, the harder it is for a person to control a ball with the gloved hand.

Figure 3:
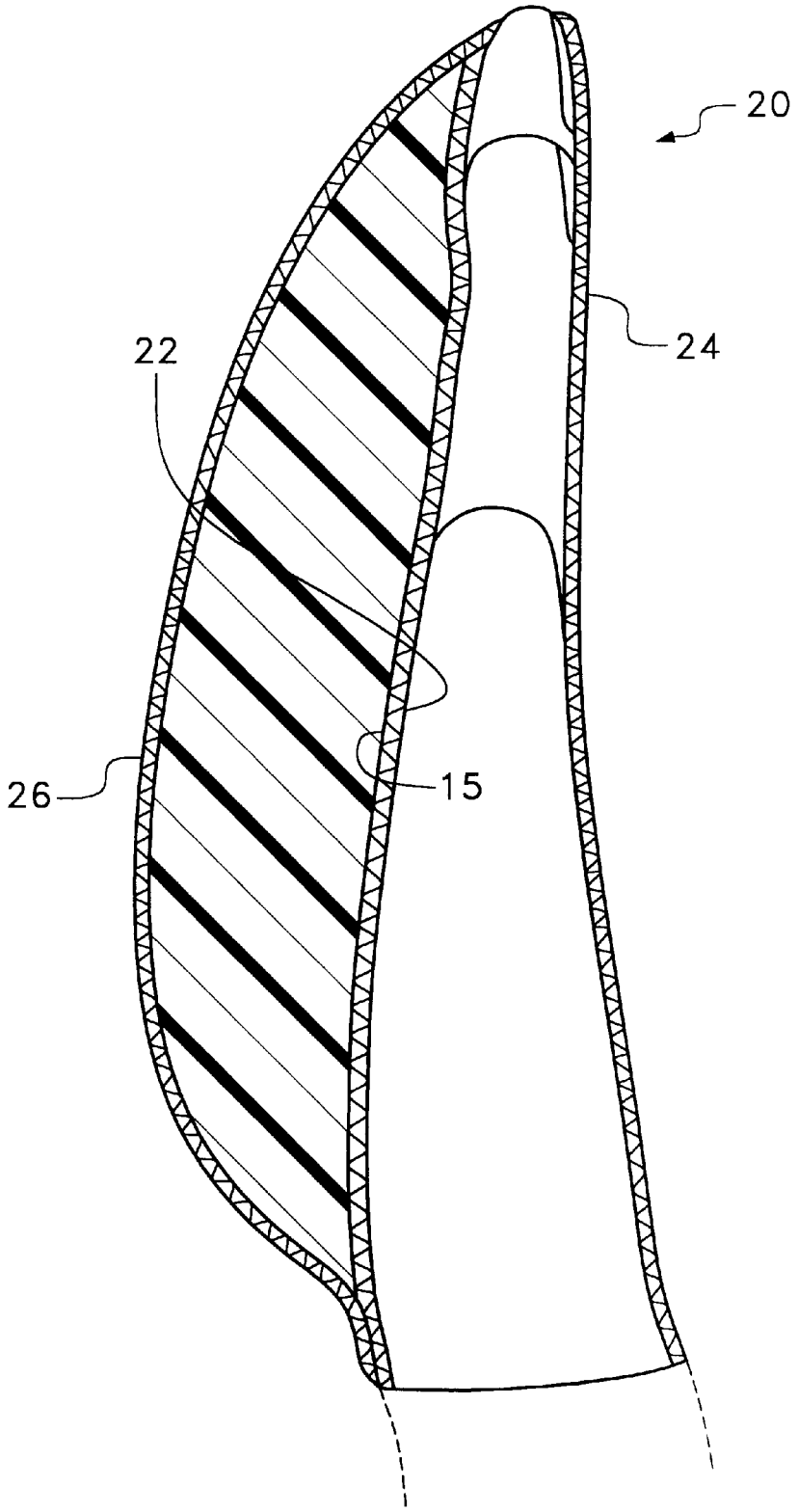
FIG. 3 is a cross-sectional view of an alternate embodiment of the Present invention device.

Referring to FIG. 3, it can be seen that the glove device 20 can cover the entire hand. Accordingly, the glove device 20 has a palm section 22 that covers the entire palm and appendages 24 that cover the entire length of each of the fingers. The convex structure 26 extends from the palm section 22 from the base of the palm to the tips of the fingers. Accordingly, a person bending his/her fingers forward would cause the convex structure 26 to buckle further outwardly. The result would be that the convex structure 26 would greatly increase the difficulty of manipulating a ball with the gloved hand.

Large glove devices, such as is shown in FIG. 3, greatly reduce the ability of a person to accurately control a ball. Such sized glove devices are therefore only needed for individuals that have great disparity between their dominant hand and their non-dominate hand. The large degree of difficulty added by the large glove device is needed to reduce the coordination of the dominant hand to a level below that of the non-dominant hand.

Figure 4:
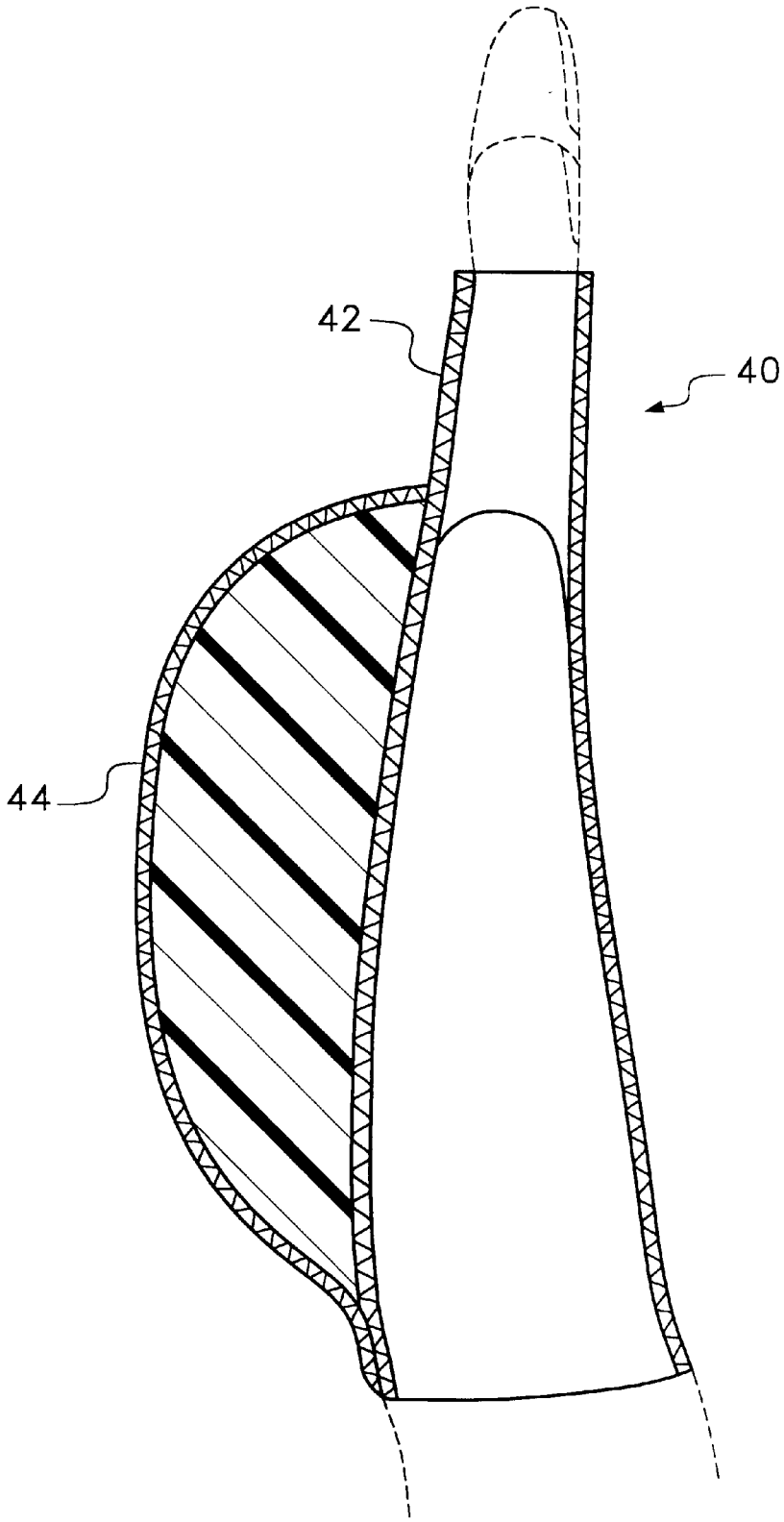
FIG. 4 is a cross-sectional view of a second alternate embodiment of the present invention device.

However, many people do not have a large disparity between their dominant hand and their non-dominant hand. With such people, large glove devices are not necessary. Rather, smaller glove devices, such as is shown in FIG. 4, can be used. Referring to FIG. 4, it can be seen that the glove device 40 can be configured so that the appendage segments 42 of the glove extend only partially up the length of the fingers. Furthermore, the convex structure 44 is smaller and extends only from the base of the palm to the top of the palm. This smaller size of the glove device 40 disrupts a person's use of his/her dominant hand to a lesser degree. Accordingly, by varying the size of the glove device and the convex structure, the degree to which the glove device effects the performance of the dominant hand can be controlled.

Referring now to FIG. 5, another embodiment of the present invention glove device 50 is shown. In this embodiment, the glove device 50 is a two piece structure comprised of a glove 52 and a palm attachment 54. The glove 52 can be any standard glove with the modification of at least one patch of a hook and loop fastener material 56 being attached to the palm of the glove 52. The palm attachment 54 is a semispherical structure having a flat surface and a convex surface. At least one patch of hook and loop material 58 is attached to the flat surface of the palm attachment 54. The hook and loop fastener material 58 on the palm attachment 54 engages the hook and loop fastener material 56 on the palm of the glove 52, thereby selectively attaching the palm attachment 54 to the glove 42.

When the palm attachment 54 is attached to the glove 52, the convex surface of the palm attachment 44 extends from the palm of the glove 52, thereby producing an assembly that performs in the sam e manner as the embodiment of FIG. 1. However, by ma king the palm attachment 54 separable from the glove 52, palm attachments 54 of different sizes can be selectively attached to the glove 52.

The present invention glove device 50 is supposed to lower a person's dominant hand coordination to a point just below that of their non-dominant hand. With different people, the amount of coordination reduction will differ. As such, different people may require different degrees of obstruction on their dominant hands. By making the semi-spherical palm attachment 54 separate from the glove 52, different sized palm attachments can be attached to the glove 52. As a result, a person can use a palm attachment 54 of the size and configuration that meets that person's needs.

In the shown embodiment, the palm attachment 54 is only slightly larger than the palm of the hand. Accordingly, the palm attachment does not extend significantly over the fingers. Such a configuration would provide a player with more control over a basketball than was available from the embodiment of FIG. 1. However, if the player's dexterity is similar between his/her dominant hand and non-dominant hand, the smaller palm attachment 54 may be all that is needed to reduce the dexterity of the dominant hand below that of the non-dominant hand.

It should be understood that the specifics of the present invention described above illustrates only exemplary embodiments of the present invention. A person skilled in the art can therefore make numerous alterations and modifications to the shown embodiments utilizing functionally equivalent components to those shown and described. All such modifications are intended to be included within the scope of the present invention as defined by the appended claims.

What is claimed is:

1. A glove, comprising:

a palmward surface that covers the palm of a hand and at least part of the fingers when said glove is worn on the hand, said palmward surface having a middle and a peripheral edge;

a convex protrusion extending from said palmward surface and covering at least a majority of said palmward surface, wherein said convex protrusion contains a flexible elastomeric material and as a maximum thickness at a point proximate said middle of said palmward surface.

2. The glove according to claim 1, wherein said maximum thickness is between one half inch and three inches.

3. The glove according to claim 1, wherein said convex protrusion slopes smoothly from said maximum thickness to said peripheral edge of said palmward surface.

4. The glove according to claim 1, wherein said convex protrusion is selectively separable from said palmward surface.

5. The glove according to claim 4, wherein said convex protrusion includes a base surface and hook and loop fastening material is present on said base surface.

6. The glove according to claim 5, wherein hook and loop fastening material is present on said palmward surface of said glove, wherein said hook and loop material engages the hook and loop fastening material on said convex protrusion and adheres said convex protrusion to said palmward surface.

7. A method of reducing the usefulness of a hand while playing a sport, comprising the steps of:

placing a glove on the hand, wherein the glove has a palmward surface that covers at least the palm of the hand;

providing a protrusion on said palmward surface of the glove that covers at least a majority of said palmward surface, wherein said protrusion is an integral part of the glove and prevents the glove from achieving a concave configuration in the area of the palmward surface regardless of the configuration of the hand within the glove.

8. The method according to claim 7, wherein said protrusion is convex in shape.

9. The method according to claim 8, wherein said palmward surface of said glove has a center and said protrusion has a maximum thickness proximate said center.

10. The method according to claim 9, wherein said maximum thickness is between one half inch and three inches.

11. The method according to claim 7, further including the step of altering the size of said protrusion depending upon the skills of the person wearing the glove.

12. A glove, comprising:

a palmward surface that covers the palm of a hand and at least part of the fingers when said glove is worn on the hand, said palmward surface having a middle and a peripheral edge;

a convex protrusion selectively attachable to said palmward surface for covering at least a majority of said palmward surface, wherein said convex protrusion as a maximum thickness where said convex protrusion covers said middle of said palmward surface; and hook and loop material disposed between said palmward surface and said convex protrusion for selectively attaching said convex protrusion to said palmward surface.

* * * * *